US010448745B2

(12) United States Patent
Lawson et al.

(10) Patent No.: US 10,448,745 B2
(45) Date of Patent: Oct. 22, 2019

(54) SPLIT OTTOMAN LINKAGE WITH RELEASE LINK

(71) Applicant: L&P PROPERTY MANAGEMENT COMPANY, South Gate, CA (US)

(72) Inventors: Gregory Mark Lawson, Tupelo, MS (US); Jason Allan Bryant, Mooreville, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/811,910

(22) Filed: Nov. 14, 2017

(65) Prior Publication Data

US 2018/0064255 A1 Mar. 8, 2018

Related U.S. Application Data

(63) Continuation-in-part of application No. 14/670,188, filed on Mar. 26, 2015, now Pat. No. 9,839,297.

(60) Provisional application No. 61/971,853, filed on Mar. 28, 2014.

(51) Int. Cl.

| | |
|---|---|
| ***A47C 7/50*** | (2006.01) |
| ***A47C 1/024*** | (2006.01) |
| ***A47C 1/035*** | (2006.01) |

(52) U.S. Cl.

CPC ..... *A47C 7/506* (2013.01); *A47C 1/024* (2013.01); *A47C 1/035* (2013.01); *A47C 7/503* (2013.01)

(58) Field of Classification Search

CPC ..... A47C 1/024; A47C 1/035; A47C 1/0355; A47C 7/503; A47C 7/506

See application file for complete search history.

(56) References Cited

U.S. PATENT DOCUMENTS

| | | | |
|---|---|---|---|
| 5,087,094 | A | 2/1992 | Rogers, Jr. |
| 5,354,116 | A | 10/1994 | May et al. |
| 5,419,611 | A | 5/1995 | Cook |
| 5,547,245 | A | 8/1996 | Knouse |
| 5,704,686 | A | 1/1998 | May |
| 5,800,010 | A | 9/1998 | May |
| 6,540,291 | B2 | 4/2003 | Hoffman et al. |
| 7,762,625 | B2 | 7/2010 | Hoffman et al. |
| 2002/0149238 | A1 | 10/2002 | Hoffman et al. |
| 2003/0227197 | A1 | 12/2003 | Tacker |
| 2008/0012396 | A1 | 1/2008 | Hoffman et al. |
| 2011/0018331 | A1 | 1/2011 | Murphy et al. |

(Continued)

OTHER PUBLICATIONS

Communication under Rule 71(3) dated Jan. 4, 2019 in European Patent Application No. 15768982.9, 28 pages.

(Continued)

*Primary Examiner* — David R Dunn
*Assistant Examiner* — Christopher E Veraa
(74) *Attorney, Agent, or Firm* — Shook, Hardy & Bacon LLP

(57) ABSTRACT

A split ottoman linkage is provided that has a slotted upper ottoman bracket. The slot of the upper ottoman bracket is shaped to maintain the pivotal coupling between the upper ottoman bracket and a front ottoman link in normal operation. If an entrapment is encountered as the split ottoman linkage closes, the slotted connection allows the upper ottoman bracket to pivot away from the entrapment to provide some relief.

11 Claims, 7 Drawing Sheets

(56) References Cited

U.S. PATENT DOCUMENTS

| | | | | |
|---|---|---|---|---|
| 2011/0248544 | A1* | 10/2011 | Adams | A47C 1/0355<br>297/423.19 |
| 2012/0119547 | A1* | 5/2012 | Hoffman | A47C 1/0355<br>297/84 |
| 2013/0200659 | A1* | 8/2013 | Hoffman | A47C 1/035<br>297/84 |
| 2013/0257110 | A1* | 10/2013 | Fischer | A47C 1/0355<br>297/83 |

OTHER PUBLICATIONS

International Search Report and Written Opinion dated Jan. 7, 2019 in International Patent Application No. PCT/US18/60777, 10 pages.

* cited by examiner

SPLIT OTTOMAN LINKAGE WITH RELEASE LINK

CROSS-REFERENCE TO RELATED APPLICATIONS

This Application claims priority to U.S. Provisional Application Ser. No. 61/971,853, filed Mar. 28, 2014, and U.S. application Ser. No. 14/670,188, filed Mar. 26, 2015, of which it is a continuation-in-part, and both of which are herein incorporated by reference in their entireties.

STATEMENT REGARDING FEDERALLY SPONSORED RESEARCH OR DEVELOPMENT

Not applicable.

TECHNICAL FIELD

Aspects of this disclosure relate to chair reclining mechanisms. More particularly, this disclosure includes embodiments relating to an extendable ottoman linkage having a split pad configuration with a release linkage.

BACKGROUND

Chairs today are often equipped with an ottoman, or a split ottoman, that extends from the front of a chair to support a user's feet and lower legs. The split ottoman is extended from a stowed position, typically in a vertical orientation directly below the front edge of the seat, to an extended position, typically in a horizontal orientation extending outwardly from the front edge of the seat. The movement of the split ottoman is controlled by a linkage to move from the stowed position to the extended position. This linkage can be manually operated, or motorized, to move between the stowed and extended positions. As the linkage moves from the extended to the stowed position, there exists a possibility that some object may move into the path of the closing linkage. This can be problematic, especially on motorized mechanisms. What is needed is an ottoman or split ottoman linkage that provides some type of release mechanism to address a situation where the path of the linkage encounters an object creating an entrapment.

BRIEF SUMMARY

The present disclosure generally relates to a split ottoman linkage having a plurality of interconnected links that move a middle ottoman and a front ottoman from a closed position to an extended position. The middle ottoman and the front ottoman are positioned adjacent one another in the closed position, and are spaced from one another in the extended position. The linkage includes a release mechanism that operates to provide relief if the linkage experiences an entrapment as the linkage moves from the extended position to the closed position.

Accordingly, in one embodiment, a split ottoman linkage for a reclining chair mechanism on a chair having a frame, a seat, and a backrest is provided. The split ottoman linkage includes a front ottoman link having first and second ends, the first end is coupled to an upper ottoman link of a reclining chair mechanism. The split ottoman linkage also includes a middle ottoman link having first and second ends, the first end being coupled to a lower ottoman link of the reclining chair mechanism and the middle ottoman link is coupled to the upper ottoman link near the first end. The split ottoman linkage further includes an upper ottoman bracket coupled to the second end of the middle ottoman link and near the second end of the front ottoman link, the middle ottoman link and upper ottoman bracket are adapted to extend the upper ottoman bracket in a relatively constant radial arc. Additionally, the split ottoman linkage includes a front ottoman bracket coupled to the second end of the front ottoman link; and a coupling link coupled between the upper ottoman bracket and the front ottoman bracket. The split ottoman linkage is adapted to move between a closed position with the upper ottoman bracket and the front ottoman bracket positioned close to one another, and an extended position where the upper ottoman bracket and the front ottoman bracket are spaced from one another. The upper ottoman bracket has a slotted coupling arrangement between it and the front ottoman link. This slotted arrangement provides a relief system if any of the upper ottoman bracket, the coupling link, the front ottoman bracket (or an ottoman board attached to the front ottoman bracket) encounter an object creating an entrapment.

In another embodiment, a split ottoman linkage for a reclining chair mechanism on a chair having a frame, a seat, and a backrest is provided. The split ottoman linkage includes a front ottoman link having first and second ends, the first end being coupled to an upper ottoman link of a reclining chair mechanism. The split ottoman linkage also includes a middle ottoman link having first and second ends, the first end being coupled to a lower ottoman link of the reclining chair mechanism. The middle ottoman link is coupled to the upper ottoman link at an upper ottoman link connection point that is closer to the first end than the second end of the middle ottoman link. Additionally, the split ottoman linkage includes an upper ottoman bracket coupled to the second end of the middle ottoman link, the upper ottoman bracket being coupled to the front ottoman link at an upper ottoman bracket connection point that is closer to the second end than the first end of the front ottoman link. The middle ottoman link and the upper ottoman bracket are adapted to extend the upper ottoman bracket in a relatively constant radial arc when the split ottoman linkage is shifted between a closed position and an extended position. The split ottoman linkage further includes a front ottoman bracket having first and second ends, the first end being coupled to the second end of the front ottoman link at a front ottoman bracket connection point. The upper ottoman bracket has a slotted coupling arrangement between it and the front ottoman link. This slotted arrangement provides a relief system if any of the upper ottoman bracket, the coupling link, the front ottoman bracket (or an ottoman board attached to the front ottoman bracket) encounter an object creating an entrapment.

In yet another embodiment, a chair having a reclining mechanism is provided. The chair includes a frame, a seat pad, a seat back, and a split ottoman linkage adapted for use with a reclining mechanism. The split ottoman linkage includes a front ottoman link having first and second ends, the first end is coupled to an upper ottoman link of a reclining chair mechanism. The split ottoman linkage also includes a middle ottoman link having first and second ends, the first end being coupled to a lower ottoman link of the reclining chair mechanism and the middle ottoman link is coupled to the upper ottoman link near the first end. The split ottoman linkage further includes an upper ottoman bracket coupled to the second end of the middle ottoman link and near the second end of the front ottoman link, the middle ottoman link and upper ottoman bracket are adapted to extend the upper ottoman bracket in a relatively constant radial arc. Additionally, the split ottoman linkage includes a front ottoman bracket coupled to the second end of the front ottoman link; and a coupling link coupled between the upper ottoman bracket and the front ottoman bracket. The split ottoman linkage is adapted to move between a closed position with the upper ottoman bracket and the front ottoman bracket positioned close to one another, and an extended position where the upper ottoman bracket and the front ottoman bracket are spaced from one another. The upper ottoman bracket has a slotted coupling arrangement between it and the front ottoman link. This slotted arrangement provides a relief system if any of the upper ottoman bracket, the coupling link, the front ottoman bracket (or an ottoman board attached to the front ottoman bracket) encounter an object creating an entrapment.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION

The subject matter of certain aspects is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Figure 1:
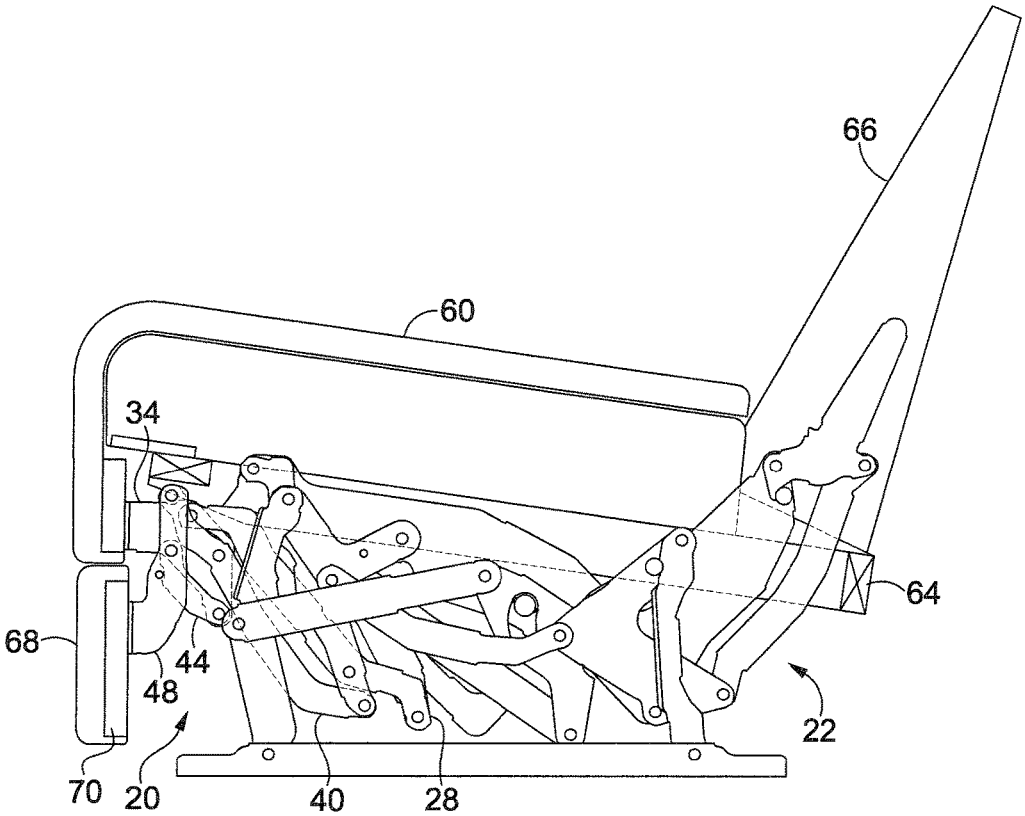
FIG. 1 is a view of an exemplary chair with a split ottoman linkage, without a release mechanism, in the closed position.
Figure 2:
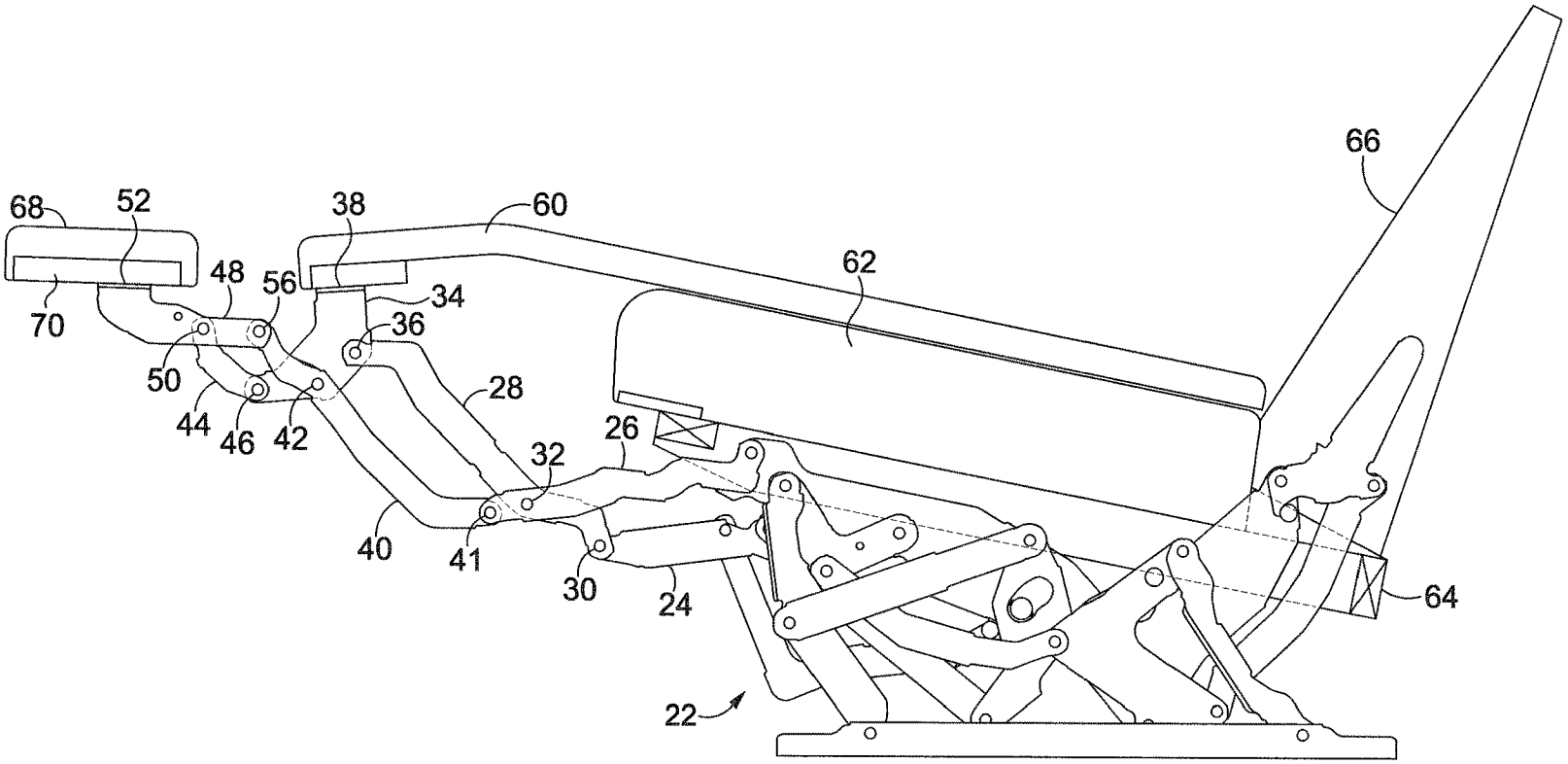
FIG. 2. is an exemplary view similar to FIG. 1 but showing the open, TV position.
Figure 3:
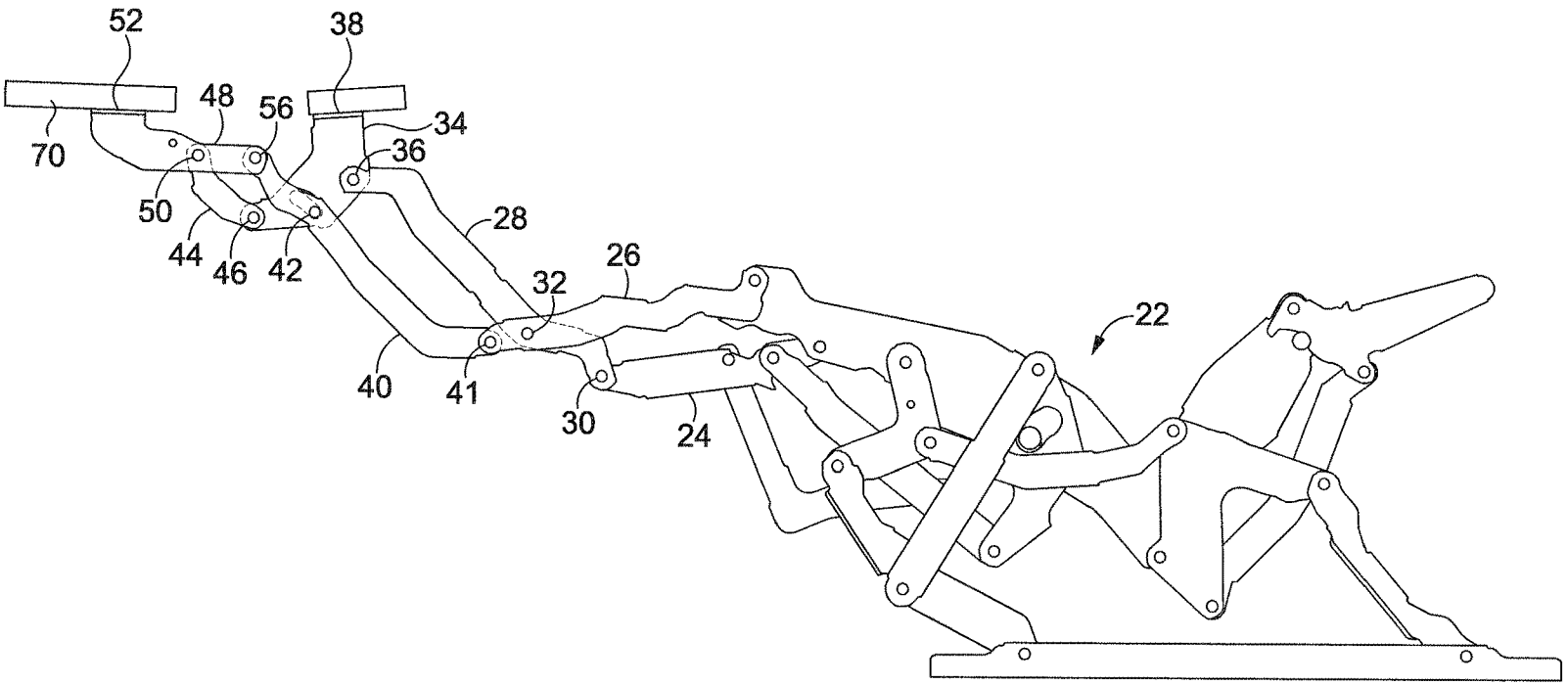
FIG. 3 is a view similar to FIG. 2, showing the fully reclined position, without the seat and chaise pad.

FIGS. 1-3 depict an exemplary chair, for reference, with a split ottoman linkage 20 positioned on a reclining mechanism 22 as described and shown in U.S. Provisional Application Ser. No. 61/971,853, filed Mar. 28, 2014, and U.S. application Ser. No. 14/670,188, filed Mar. 26, 2015 herein incorporated by reference in their entireties. The split ottoman linkage 20 is depicted in the closed position in FIG. 1, with FIG. 2 in the open or TV position, and FIG. 3 in the fully reclined position. Additionally, FIGS. 1 and 2 schematically show the position of at least a portion of the frame 64, chaise pad 60, front pad 68 covering an ottoman board 70, and seat back 66 relative to the split ottoman linkage 20 and the reclining mechanism 22. It should be understood that the exemplary views of FIGS. 1-3 have various chair parts removed and/or have other parts superimposed on other elements in order to highlight relevant features of split ottoman linkage 20 and reclining mechanism 22. While shown in use on a particular reclining mechanism 22, it should be understood that the ottoman linkage 20 is usable on virtually any reclining mechanism configuration with only minimal alteration. An exemplary reclining mechanism on which the ottoman linkage 20 could be used is described in U.S. patent application Ser. No. 14/064,700, which was filed on Oct. 28, 2013, the disclosure of which is hereby incorporated by reference in its entirety.

Ottoman linkage 20 includes a series of interconnected links that control the extension and retraction of the ottoman from the closed position depicted in FIG. 1, to the open position depicted in FIGS. 2 and 3. It should be understood that while only one split ottoman linkage 20 is described and depicted in the figures, a pair of split ottoman linkages can be present on a chair, with each essentially being a mirror image of the other and disposed in opposing-facing relation about a longitudinally-extending plane that bisects the chair. As such, the ensuing discussion will focus on only one of the split ottoman linkages, e.g., split ottoman linkage 20, with the content being equally applied to the other complimentary split ottoman linkage assembly.

It should be understood and appreciated that the components of split ottoman linkage 20 discussed herein may be formed from any suitable material known in the furniture-manufacturing industry, such as metal stock (e.g., stamped, formed steel) for brackets, plates, and links. Further, it should be understood and appreciated that the components may be connected together using any techniques or mechanisms known in the furniture-manufacturing industry. For example, components that are rigidly connected may be connected via rivets, bolts, welding, etc. In addition, the shapes of the components described herein may vary, as well as any connection or attachment points between components.

As best seen in FIG. 2, the ottoman linkage 20 is coupled to reclining mechanism 22 via a lower ottoman link 24 and an upper ottoman link 26. Lower ottoman link 24 and upper ottoman link 26 exist in one form or another on various existing reclining mechanisms, such as reclining mechanism 22. Ottoman linkage 20 is coupled to lower ottoman link 24 through the pivotable coupling of a middle ottoman link 28 at connection point 30. Middle ottoman link 28 is also pivotably coupled to upper ottoman link 26 at connection point 32, i.e., ottoman drive connection point 32. At the end of middle ottoman link 28 opposite from connection point 30, middle ottoman link 28 is pivotably coupled to an upper ottoman bracket 34 at connection point 36, i.e., middle ottoman link connection point 36. Upper ottoman bracket 34 has an upper end terminating in a horizontally extending chaise pad attachment platform 38. Upper ottoman bracket 34 has a shallow C shape, and is pivotably connected to a front ottoman link 40 at a connection point 42, i.e., upper ottoman bracket connection point 42, below connection point 36 (as viewed in FIG. 2). The lower end of front ottoman link 40 is pivotably coupled to upper ottoman link 26 at connection point 41. The end of upper ottoman bracket 34 opposite horizontally extending chaise pad attachment platform 38 is pivotably coupled to a coupling link 44 at a connection point 46, i.e., coupling link connection point 46. Coupling link 44 operates to couple the upper ottoman bracket 34 to a front ottoman bracket 48 through a pivotal coupling 50. The front ottoman bracket 48 has an upper end terminating in a horizontally extending front ottoman pad attachment platform 52. Platform 52 is used as an attachment and support surface for a front ottoman pad 68, which is in turn disposed on an ottoman board 70. The end of front ottoman bracket 48 opposite pad 68 is pivotably coupled to front ottoman link 40 at connection point 56, i.e., front ottoman bracket connection point 56.

It is understood and appreciated that the pivotable couplings between the linkages described above and elsewhere herein can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot and/or connection points. It will be understood that when a linkage is referred to as being pivotably "coupled" to, "connected" to, "interconnected" with, "attached" on, etc., another element (e.g., linkage, bracket, frame, and the like), it is contemplated that the linkage and elements may be in direct contact with each other, or other elements, such as intervening elements, may also be present.

As shown in FIGS. 1 and 2, the chair used with ottoman linkage 20 may have a chaise pad 60. The front of chaise pad 60 can be connected to the horizontally extending chaise pad attachment platform 38. The chaise pad 60 can be connected to the horizontally extending chaise pad attachment platform 38 in any manner known to one skilled in the art, such as with staples, adhesive, and the like. As the ottoman linkage 20 extends from the closed position shown in FIG. 1 to the open position shown in FIG. 2, the front of the chaise pad 60 moves from a somewhat vertical position depicted in FIG. 1 to the horizontal position depicted in FIG. 2. As the ottoman linkage 20 extends, the links cooperate to maintain a relatively constant radial arc for the horizontally extending chaise pad attachment platform 38, such that the front of chaise pad 60 is supported at a relatively constant distance with respect to a seat cushion 62. This enables the chaise pad 60 to extend, and be supported, without being pulled away from seat cushion 62. Additionally, as ottoman linkage 20 extends, the front ottoman pad 68 moves from a position as shown in FIG. 1 directly adjacent and abutting the front of chaise pad 60, to an extended position away from the front of chaise pad 60 as shown in FIG. 2.

The ottoman linkage 20 can shift from a closed to an extended position by initiating movement of upper ottoman link 26 and lower ottoman link 24 from the vertical position depicted in FIG. 1 to the horizontal position depicted in FIG. 2. One can initiate this movement with the use of standard mechanisms known in the art, such as a release lever or a motor. As upper ottoman link 26 and lower ottoman link 24 move from a vertical position to a horizontal position, middle ottoman link 28 and front ottoman link 40 move away from seat cushion 62 and upward, rotating about connection points 30 and 41, respectively. As middle ottoman link 28 and front ottoman link 40 move away from seat cushion 62 and upward, upper ottoman bracket 34 rotates from the vertical position depicted in FIG. 1 to the horizontal position depicted in FIG. 2 at least partly by rotating about connection point 36. As upper ottoman bracket 34 rotates and moves, coupling link 44 and front ottoman bracket 48 are urged forward and upward through a force applied at least partly to connection points 50 and 46. As upper ottoman bracket 34 extends to the horizontal position depicted in FIG. 2, front ottoman link 40 continues to apply a force to front ottoman bracket 48 at least at connection point 56 causing front ottoman bracket 48 to rotate about connection point 50 and extend outward until coupling link 44 and front ottoman link 40 restrict any further outward movement of front ottoman bracket 48. As shown in FIG. 3, the reclining mechanism 22 may be moved to a fully-reclined position as well.

One can retract the split ottoman linkage 20, e.g., shift from an extended position to a closed position, by initiating movement of upper ottoman link 26 and lower ottoman link 24 from the horizontal position depicted in FIG. 2 to the vertical position depicted in FIG. 1. In motorized mechanisms, this is accomplished by reversing the motor, by initiating a switch. One difficulty that could be encountered in retracting a motorized version of split ottoman linkage 20 shown in FIGS. 1-3 is when the mechanism encounters some object that may become entrapped by the linkage. More specifically, as the split ottoman linkage 20 retracts, any of the ottoman board 70, the front ottoman bracket 48, the coupling link 44 or the upper ottoman bracket 34 may encounter an object as it closes. As an example, a pet or toy may be present and in the path of the links described above. As the mechanism continues to close, an entrapment may be created.

Figure 4:
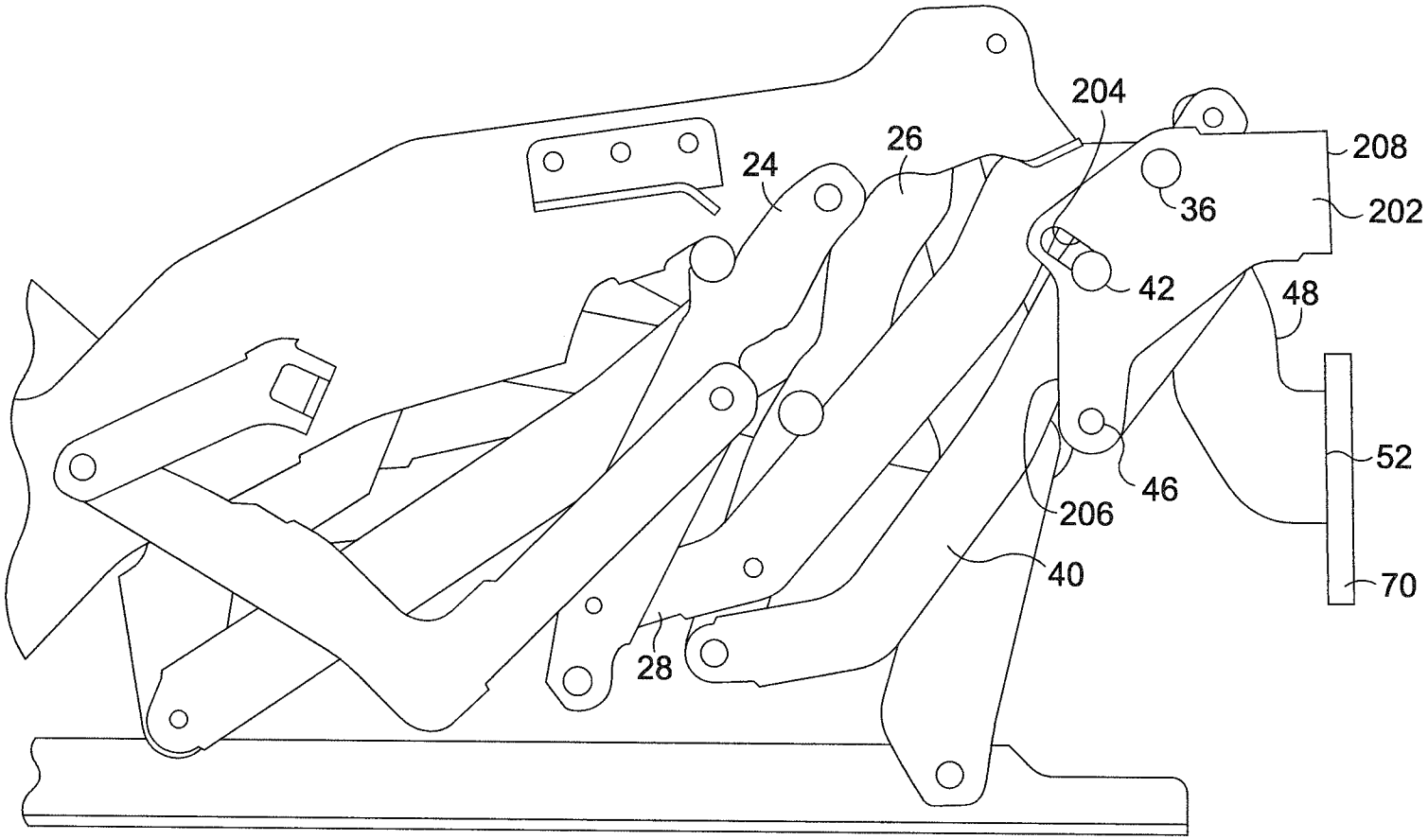
FIG. 4 is a partial view of a mechanism, similar to FIGS. 1-3, but having a split ottoman linkage shown in the closed position, with a release mechanism.
Figure 5:
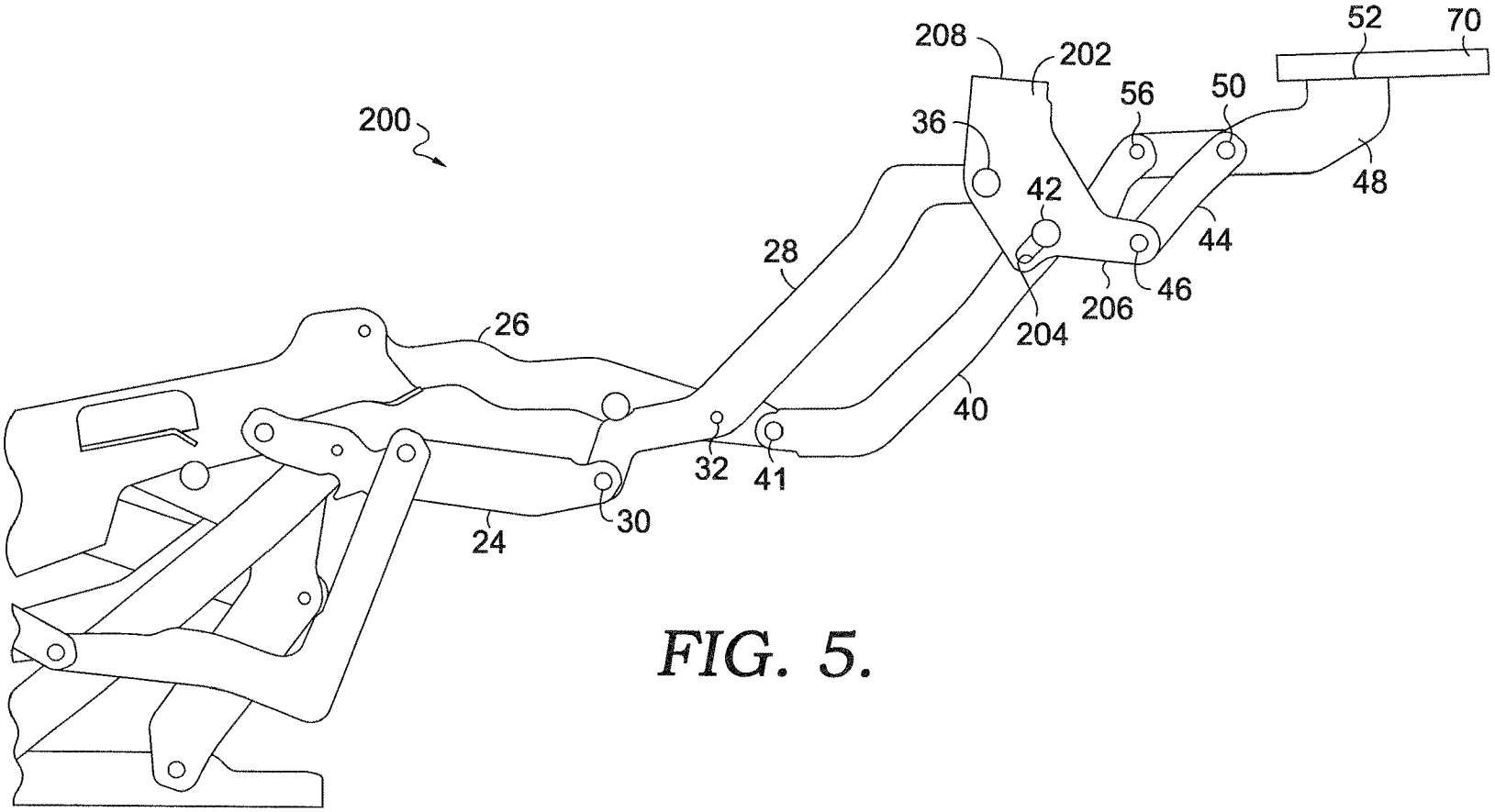
FIG. 5 is a view similar to FIG. 4, showing the split ottoman linkage in the fully-extended position.

An alternative split ottoman linkage 200 is shown in FIGS. 4 and 5. FIGS. 4 and 5 show only partial versions of the mechanisms, for simplicity. Split ottoman linkage 200 includes the upper ottoman link 26, lower ottoman link 24, middle ottoman link 28 and front ottoman link 40, as described above with reference to FIGS. 1-3. Upper ottoman link 26 is pivotably coupled on one end to the seat mounting plate, and is coupled on the other end to front ottoman link 40 at pivot 41. Lower ottoman link 24 is also pivotably coupled on one end to the seat mounting plate, and on the other end is coupled to middle ottoman link 28 at pivot 30. Middle ottoman link 28 is also pivotably coupled to upper ottoman link 26 at pivot 32.

Split ottoman linkage 200 has a modified upper ottoman bracket 202. As best seen in FIG. 5, upper ottoman bracket 202 is shaped similarly to upper ottoman bracket 34. Upper ottoman bracket 202 is pivotably coupled to middle ottoman link 28 at pivot point 36. Upper ottoman bracket has an upper end terminating in a chaise pad attachment platform 208. Upper ottoman bracket 202 is pivotably coupled to a control link 44 at pivot point 46. The other end of control link 44 is pivotably coupled to a front ottoman bracket 48 at pivot 50. Front ottoman bracket 48 has an upper end terminating in a horizontally extending front ottoman pad attachment platform 52, to which an ottoman board 70 is attached. The other end of front ottoman bracket 48 is pivotably coupled to front ottoman link 40 at pivot 56. The opposite end of front ottoman link 40 is pivotably coupled to upper ottoman link 26 at pivot 41.

Figure 7:
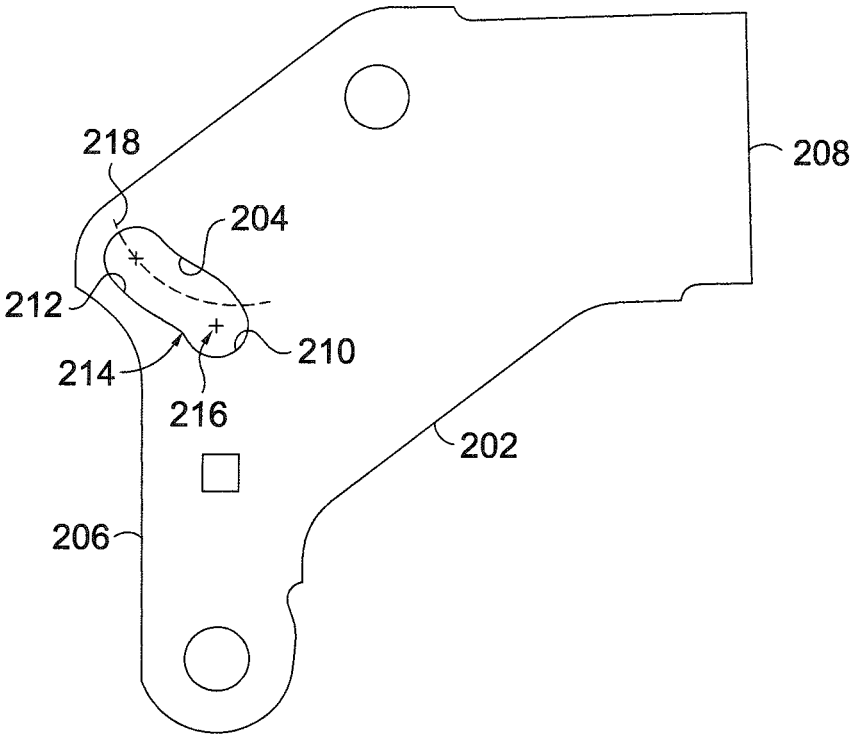
FIG. 7 is an enlarged view of the upper ottoman bracket of FIGS. 4-6.

As best seen in FIG. 5, upper ottoman bracket 202 is coupled to front ottoman link 40 at pivot 42. Upper ottoman bracket 202 and front ottoman bracket 48 rotate from the closed position of FIG. 4, to the extended position of FIG. 5, with the chaise pad attachment platform 208 and the front ottoman pad attachment platform 52 (and ottoman board 70) rotating from a vertical position (FIG. 4) to a horizontal position (FIG. 5). As best seen in FIGS. 5 and 7, upper ottoman bracket 202 has a slot 204 formed therein. As best seen in FIG. 7, slot 204 has a complex shape. More specifically, the slot 204 does not have a constant radius. A generally circular front end 210, having a center point 216, is offset from a curved second end 212, having a radius 218, to define a transition point 214. As can be seen in FIG. 7, the center point 216 does not lie on the radius 218, creating the offset and thus the transition point 214.

In operation, pivot 42, such as a rivet, normally resides in the front end 210 of the slot 204, as seen in FIGS. 4 and 5. The offset of the front end 210 from the arc of the second end 212 at transition point 214 operates to maintain the pivot 42 in the front end 210 of the slot during normal operation. In other words, the transition point 214 operates to maintain pivot 42 within the circular front end 210 of the slot 204 as the split ottoman linkage 200 moves back and forth between the closed position of FIG. 4 and the extended position of FIG. 5.

Figure 6:
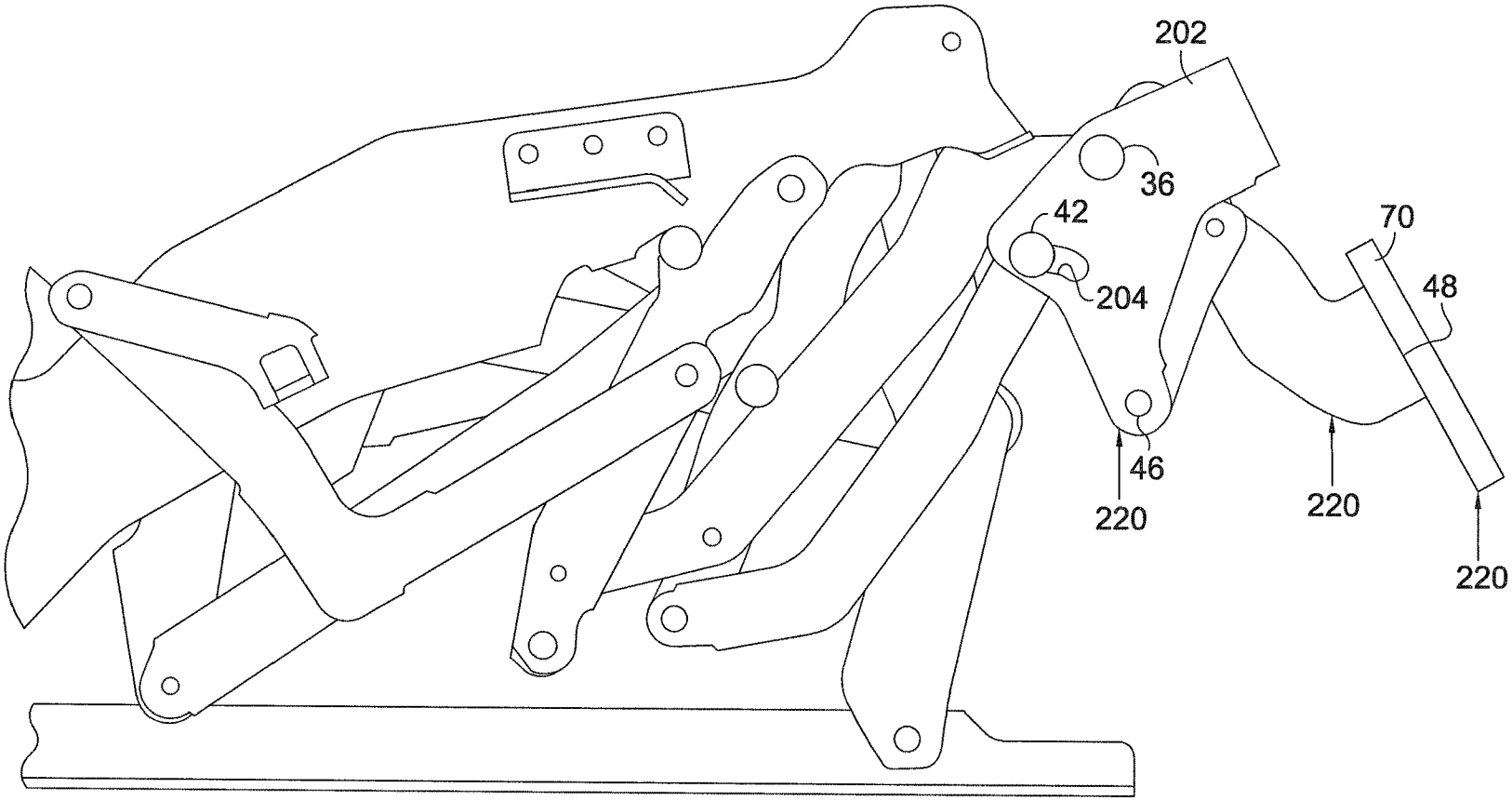
FIG. 6 is a view similar to FIG. 4, but showing the position of the relief mechanism when an entrapment is encountered.

As the split ottoman linkage 200 moves from the extended position of FIG. 5 to a closed position, any of the ottoman board 70, the front ottoman bracket 48, the coupling link 44 or the upper ottoman bracket 202 may encounter an object as the linkage closes. The object may create an entrapment between the respective link and the floor, and will impart a reactive force (such as the reactive forces depicted by arrows 220 in FIG. 6). This reactive force will overcome the retaining properties of the transition point 214, and allow pivot 42 to leave the front end 210 of the slot 204. If the split ottoman linkage 200 continues to close (such as by being driven by a motor in a powered mechanism), the second end 212 of the slot 204 allows the front ottoman bracket 202 to pivot about pivot point 36. The range of motion of the front ottoman bracket 202 is limited by the length of slot 204. As the pivot 42 abuts the end of the second end 212 of slot 204, the pivoting motion of the front ottoman bracket 202 will stop. This position is shown in FIG. 6. In one exemplary aspect, the length of the slot can allow for relief of an entrapment of somewhere between 4-8 inches of movement of upper ottoman bracket 202 (as well as the other links extending forwardly of upper ottoman bracket 202), and more particularly, relief of about 6 inches of movement, to be accommodated. After an entrapment is relieved, the split ottoman linkage 202 can be powered to an extended position, moving the pivot 42 from the second end 212 of slot 204 back to the front end 210. Once back in front end 210, the transition point 214 will maintain pivot 42 within the front end 210 of the slot 204, allowing the split ottoman linkage 200 to open and close normally between the positions shown in FIG. 5 and FIG. 4. The slot 204 within upper ottoman bracket 202 thus creates a relief mechanism if an entrapment situation is encountered. The offset of center point 216 from the radius 218 creates a transition point 214 that maintains the rotational movement of upper ottoman bracket 202 in movement from the closed position of FIG. 4 to the extended position of FIG. 5. The position of the pivot 42 within the front end 210 is maintained unless and until the surface 206 of upper ottoman bracket 202 encounters an object creating an entrapment.

From the foregoing, it will be seen that the disclosed reclining mechanism is well adapted to attain all the ends and objects hereinabove set forth together with other advantages, which are obvious and inherent to the structure.

It will be understood that certain features and subcombinations are of utility and may be employed without reference to other features and subcombinations. This is contemplated by and is within the scope of the claims.

Since many possible alternative reclining mechanisms may be made without departing from the scope thereof, it is to be understood that all matter herein set forth or shown in the accompanying drawings is to be interpreted as illustrative and not in a limiting sense.

What is claimed is:

1. A split ottoman linkage for a reclining chair mechanism on a chair having a frame, a seat, and a backrest, where the reclining chair mechanism has an upper ottoman link, and a lower ottoman link, comprising:

a front ottoman link having first and second ends, the first end being coupled to the upper ottoman link of the reclining chair mechanism;

a middle ottoman link having first and second ends, the first end of the middle ottoman link being coupled to the lower ottoman link, the middle ottoman link also being coupled to the upper ottoman link near the first end of the upper ottoman link;

an upper ottoman bracket pivotably coupled to the second end of the middle ottoman link and also pivotably coupled to the front ottoman link near the second end of the front ottoman link, the upper ottoman bracket having a slot located at a point coupling the upper ottoman bracket to the front ottoman link;

a front ottoman bracket coupled to the second end of the front ottoman link; and a coupling link coupled between the upper ottoman bracket and the front ottoman bracket;

wherein the split ottoman linkage is adapted to move between a closed position with the upper ottoman bracket and the front ottoman bracket positioned close to one another, and an extended position where the upper ottoman bracket and the front ottoman bracket are spaced from one another, wherein the slot on the upper ottoman bracket has a first end and a second end spaced from the first end, wherein the first end of the slot is formed as a generally circular hole, having a center point, and wherein the second end of the slot is formed as an arc extending from the circular hole of the first end, where the arc has a radius that is offset from the center point of the circular hole of the first end.

2. The split ottoman linkage of claim 1, wherein the slot includes a transition point at the junction of the circular hole of the first end and the radial arc of the second end.

3. The split ottoman linkage of claim 2, wherein the pivotal coupling of the upper ottoman bracket and the front ottoman link is maintained in the circular hole of the first end by the transition point.

4. The split ottoman linkage of claim 3, wherein upper ottoman bracket has a surface generally extending between the coupling of the upper ottoman bracket and the middle ottoman link, and the coupling of the upper ottoman bracket and the coupling link, and wherein the slot of the upper ottoman bracket allows the upper ottoman bracket to rotate about the coupling of the upper ottoman bracket and the middle ottoman link if the surface of the upper ottoman bracket hits an object as the split ottoman linkage moves from the extended position to the closed position.

5. A split ottoman linkage for a chair having a reclining chair mechanism with an upper ottoman link, and a lower ottoman link, comprising:

a front ottoman link having first and second ends, the first end adapted to be coupled to the upper ottoman link of the reclining chair mechanism;

a middle ottoman link having first and second ends, the first end of the middle ottoman link adapted to be coupled to the lower ottoman link, the middle ottoman link also adapted to be coupled to the upper ottoman link near the first end of the upper ottoman link;

an upper ottoman bracket pivotably coupled to the second end of the middle ottoman link and also pivotably coupled to the front ottoman link near the second end of the front ottoman link, the upper ottoman bracket having a slot located at a point coupling the upper ottoman bracket to the front ottoman link;

a front ottoman bracket coupled to the second end of the front ottoman link; and a coupling link coupled between the upper ottoman bracket and the front ottoman bracket;

wherein the split ottoman linkage is adapted to move between a closed position with the upper ottoman bracket and the front ottoman bracket in a stowed positioned close to one another, and an extended position where the upper ottoman bracket and the front ottoman bracket are in an extended position spaced from one another, wherein the slot on the upper ottoman bracket has a first end and a second end spaced from the first end, wherein the first end of the slot is formed as a generally circular hole, having a center point, and wherein the second end of the slot is formed as an arc extending from the circular hole of the first end, where the arc has a radius that is offset from the center point of the circular hole of the first end.

6. The split ottoman linkage of claim 5, wherein the slot includes a transition point at the junction of the circular hole of the first end and the radial arc of the second end.

7. The split ottoman linkage of claim 6, wherein the pivotal coupling of the upper ottoman bracket and the front ottoman link is maintained in the circular hole of the first end by the transition point.

8. The split ottoman linkage of claim 7, wherein upper ottoman bracket has a surface generally extending between the coupling of the upper ottoman bracket and the middle ottoman link, and the coupling of the upper ottoman bracket and the coupling link, and wherein the slot of the upper ottoman bracket allows the upper ottoman bracket to rotate about the coupling of the upper ottoman bracket and the middle ottoman link if the surface of the upper ottoman bracket hits an object as the split ottoman linkage moves from the extended position to the closed position.

9. A chair having a reclining mechanism with at least an upper ottoman link and a lower ottoman link, the chair comprising:

a frame;

a seat pad;

a seat back; and a split ottoman linkage adapted for use with the reclining mechanism, the split ottoman linkage comprising:

a front ottoman link having first and second ends, the first end adapted to be coupled to the upper ottoman link of the reclining chair mechanism;

a middle ottoman link having first and second ends, the first end of the middle ottoman link adapted to be coupled to the lower ottoman link, the middle ottoman link also adapted to be coupled to the upper ottoman link near the first end of the upper ottoman link;

an upper ottoman bracket pivotably coupled to the second end of the middle ottoman link and also pivotably coupled to the front ottoman link near the second end of the front ottoman link, the upper ottoman bracket having a slot located at a point coupling the upper ottoman bracket to the front ottoman link;

a front ottoman bracket coupled to the second end of the front ottoman link; and a coupling link coupled between the upper ottoman bracket and the front ottoman bracket;

wherein the split ottoman linkage is adapted to move between a closed position with the upper ottoman bracket and the front ottoman bracket in a stowed positioned close to one another, and an extended position where the upper ottoman bracket and the front ottoman bracket are in an extended position spaced from one another, wherein the slot on the upper ottoman bracket has a first end and a second end spaced from the first end, wherein the first end of the slot is formed as a generally circular hole, having a center point, and wherein the second end of the slot is formed as an arc extending from the circular hole of the first end, where the arc has a radius that is offset from the center point of the circular hole of the first end.

10. The chair according to claim 9, wherein the slot includes a transition point at the junction of the circular hole of the first end and the radial arc of the second end.

11. The chair according to claim 10, wherein the pivotal coupling of the upper ottoman bracket and the front ottoman link is maintained in the circular hole of the first end by the transition point.

* * * * *